US005697622A

United States Patent [19]

Warinner

[11] Patent Number: 5,697,622

[45] Date of Patent: Dec. 16, 1997

[54] DOUBLE LINE ROLLER SKATE

[76] Inventor: Peter Q. Warinner, P.O. Box 590, Freeport, N.Y. 11520

[21] Appl. No.: 559,679

[22] Filed: Nov. 20, 1995

[51] Int. Cl.[6] ..... A63C 1/00

[52] U.S. Cl. ..... 280/11.19; 280/11.2; 280/11.22; 280/11.27; 188/5

[58] Field of Search ..... 280/11.19, 11.2, 280/11.22, 11.27, 7.1; 301/5.3, 5.7; 188/5

[56] References Cited

U.S. PATENT DOCUMENTS

| | | | |
|---|---|---|---|
| 31,994 | 4/1861 | Pennie | 280/11.19 |
| 103,346 | 5/1870 | Lemman | 280/11.19 |
| 243,323 | 6/1881 | Sutton | 280/11.19 |
| 287,820 | 11/1883 | Gallaher | 280/11.19 |
| 657,790 | 9/1900 | Ross | 301/5.3 |
| 2,048,916 | 7/1936 | Bentzlin | 280/11.2 |
| 2,058,164 | 10/1936 | Marx | 280/11.19 |
| 2,166,767 | 7/1939 | Petermann . | |
| 3,414,280 | 12/1968 | Ohashi | 280/11.19 |
| 5,069,462 | 12/1991 | Murga . | |
| 5,192,088 | 3/1993 | Yu . | |
| 5,251,920 | 10/1993 | McHale . | |
| 5,398,949 | 3/1995 | Tarng | 280/11.22 |
| 5,413,380 | 5/1995 | Fernandez | 280/11.19 |
| 5,549,309 | 8/1996 | Gleichmann | 280/11.19 |

*Primary Examiner*—Brian L. Johnson
*Assistant Examiner*—Min Yu
*Attorney, Agent, or Firm*—Michael I. Kroll

[57] ABSTRACT

A double line roller skate (10) comprising a plurality of dual rollers (12). A structure (14) is for retaining the dual rollers (12) rotatively in longitudinal alignment, one behind the other. A facility (16) is for holding the retaining structure (14) onto a foot of a skater (18).

1 Claim, 2 Drawing Sheets

Fig. 1
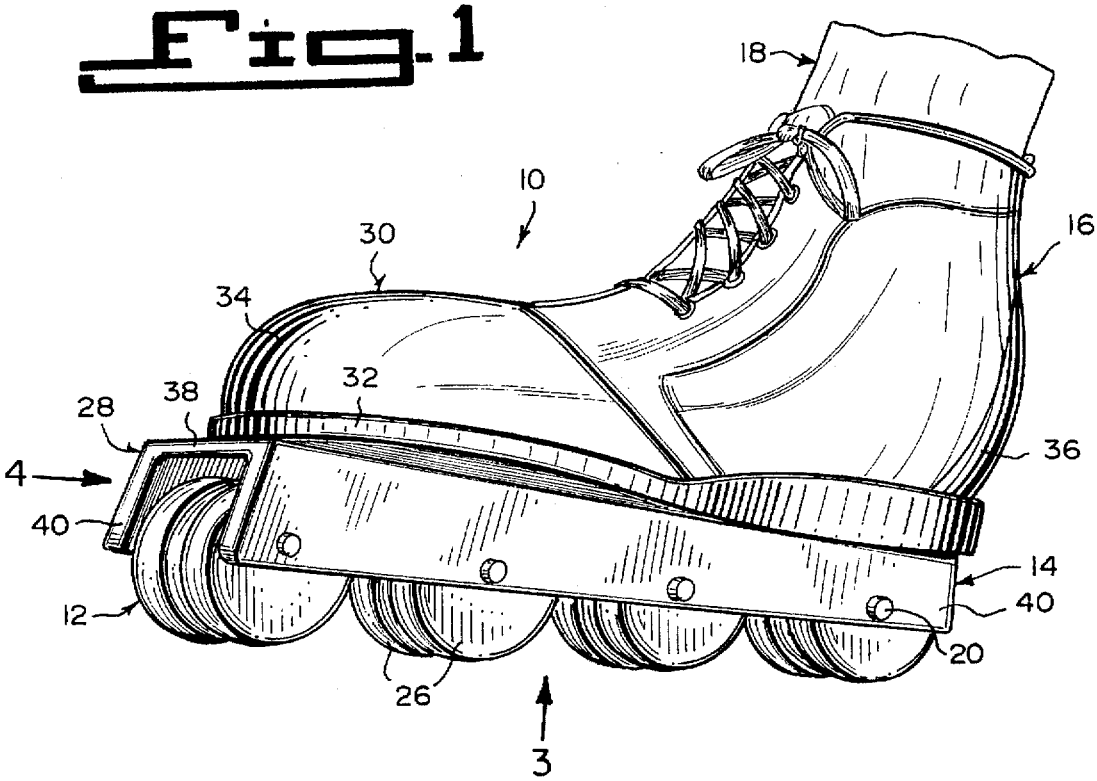
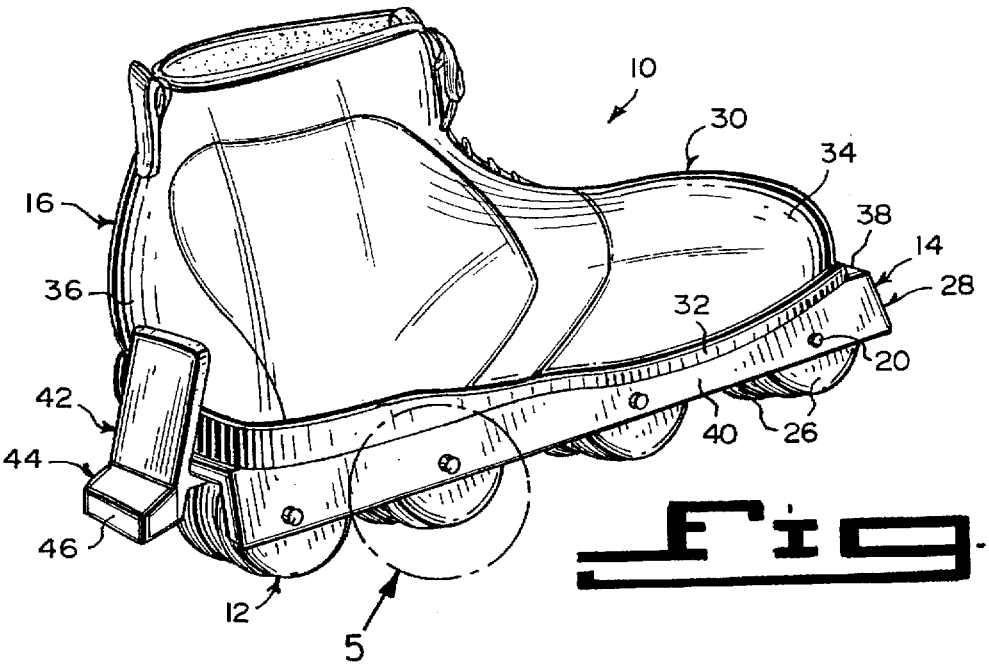
Fig. 2

DOUBLE LINE ROLLER SKATE

DESCRIPTION OF THE PRIOR ART

Numerous roller skates have been provided in prior art. For example, U.S. Pat. Nos. 2,166,767 to Petermann; 5,069,462 to Murga; 5,192,088 to Yu and 5,251,920 to McHale all are illustrative of such prior art. While these units may be suitable for the particular purpose to which they address, they would not be as suitable for the purposes of the present invention as heretofore described.

PETERMANN, HENRI

ROLLER SKATE

U.S. Pat. No. 2,166,767

A roller skate comprising an elongated support. A plurality of axles are carried by the support. A pair of separate rollers are carried by each axle. Each roller comprises an outer rim member having a spherical bearing surface constituting a continuation of the spherical bearing surface of the other roller carried by the same axle. A ball bearing is interposed between the rim member and the axle and comprises an inner ring fitting within the rim member and is rotatable therewith. A sleeve is mounted upon the axle. A row of balls are situated between the inner ring and the sleeve. The axle has a threaded portion. A nut is screwed upon the threaded portion and engages the sleeve.

MURGA, JOSE

ROLLER SKATE INCLUDING AT LEAST TWO ROLLERS ALIGNED ALONG A MEDIAN PLANE

U.S. Pat. No. 5,069,462

The skate includes an under-free equipped with two or several rollers aligned one behind the other in a common median plane. Each roller has a shape of a narrow-bobbin, with two circular flanges provided with bands and a central hollowed hub fixed inside a ball-bearing. This bearing is put in an orifice of a central plate of the under-frame. This plate holds also a front buffer-stop and a back buffer-stop. An instrument absorbing the shocks in the radial direction if intercalated between the bearing and the plate. Preferably, the under-frame of the skate is equipped with a support for a leg, which is articulated in relation to a transverse axis at the level of the ankle. A braking mechanism of the rollers can be fixed on the central plate of the under-frame. Thanks to the special shape of the rollers, bearings and the under-frame are lightened.

YU, CHUNG-HSIUNG

ROLLER SKATE WITH DEVICE FOR ASSISTING THE TURNING AND BRAKING ACTION THEREOF

U.S. Pat. No. 5,192,088

A roller skate having rollers aligned along a longitudinal axis thereof is equipped with a device which includes a mounting seat attached to the skate body adjacent to the front or rear end thereof. A pair of mounting shafts are mounted on the mounting seat and extend in such a manner that they form an angle therebetween and that they are symmetric with respect to the longitudinal axis. A pair of auxiliary rollers are mounted respectively to the mounting shafts, so that they lie in two imaginary planes which are perpendicular to the mounting shafts, respectively, and which form a V-shape symmetric with respect to the longitudinal axis. The device assists the turning and braking action of the roller skate.

McHALE, PATRICK

BEAM OFF-SET ROLLER SKATE

U.S. Pat. No. 5,251,920

Roller skates having a shoe or boot supported by a central support beam. The boot has an inside and outside corresponding to the inside and the outside of a user's foot to which it is designed to be removably attached. Each skate also has a first and second group of wheels in longitudinal alignment with the roller skate and in rotatable alignment with each other. The boot and groups of wheels are connected to a support structure. The first group of wheels is rotatably attached to the support structure and disposed to the outside thereof. The second group of wheels is rotatably attached to the support structure and disposed to the inside thereof. A first span between the most distant of the wheels of the first group of wheels is less than a second span between the most distant of the wheels of the second group of wheels. There are also brake means for slowing and stopping the roller skate when a user desires.

SUMMARY OF THE INVENTION

A primary object of the present invention is to provide a double line roller skate that will overcome the shortcomings of the prior art devices.

Another object is to provide a double line roller skate that will have greater stability than traditional roller skates or in-line roller skates.

An additional object is to provide a double line roller skate that is a safer skate for beginners and children, since it is less likely a user will get injured, especially an ankle and leg injury, when skating.

A further object is to provide a double line roller skate that is simple and easy to use.

A still further object is to provide a double line roller skate that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 1 is a front perspective view of the instant invention.

FIG. 2 is a rear perspective view of the instant invention.

Similar reference characters denote corresponding features consistently throughout the attached drawings.

DETAILED DESCRIPTION OF THE PREFERRED EMBODIMENTS

Figure 3:
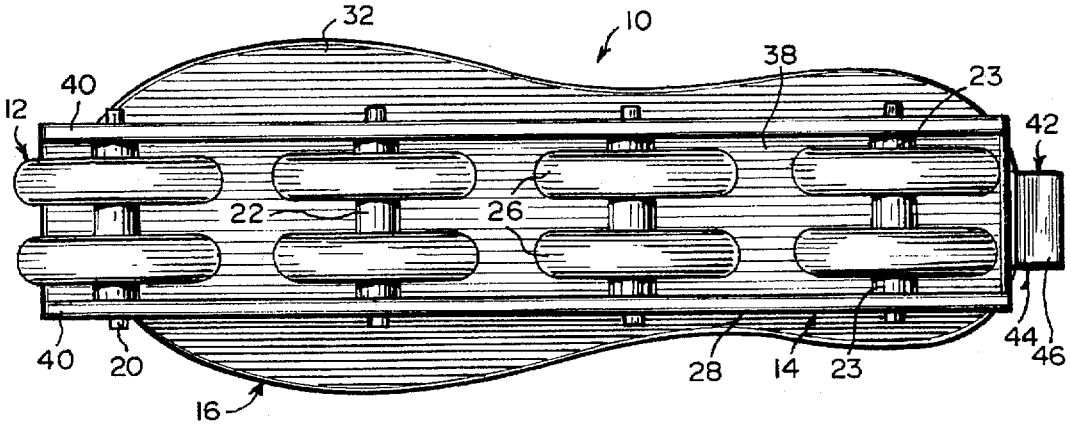
FIG. 3 is a bottom view taken in the direction of arrow 3 in FIG. 1.
Figure 4:
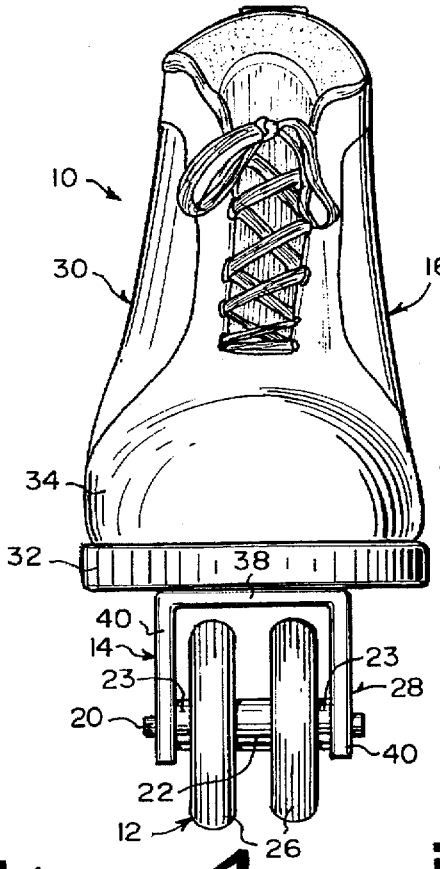
FIG. 4 is a front view taken in the direction of arrow 4 in FIG. 1.

Turning now descriptively to the drawings, in which similar reference characters denote similar elements throughout the several views, FIGS. 1 through 5 illustrate a double line roller skate 10 comprising a plurality of dual rollers 12. A structure 14 is for retaining the dual rollers 12 rotatively in a longitudinal alignment, one behind the other. A component 16 is for holding the retaining structure 14 onto a foot of a skater 18.

Each dual roller 12 includes an axle 20 supported at opposite ends in the retaining structure 14. A central bushing 22 is placed on the axle 20. A pair of end bushings 23 are also placed on the axle 20. A pair of bearings 24 are provided. Each bearing 24 is placed on the axle 20 between the central bushing 22 and one of the end bushings 23. A pair of narrow wheels 26 are also provided. Each narrow wheel 26 is carried on one bearing 24.

The retaining structure 14 is an inverted U-shaped channel bracket 26 affixed to the foot holding component 16. The foot holding component 16 is a boot 30, having a sole 32 that is affixed to the retaining structure 14.

The plane of each narrow wheel 26 is perpendicular to the ground when the narrow wheels 26 are at rest. The plane of each narrow wheel 26 is also perpendicular to the sole 32 of the boot 30.

The first dual roller 12 can be, but not necessarily located, below a toe 34 of the boot 30. The last dual roller 12 can be, but not necessarily located, below a heel 36 of the boot 30. The inverted U-shaped channel bracket 28 consists of a horizontal base 38 affixed to an underside of the foot holding component 16. A pair of vertical arms 40 extend downwardly from the horizontal base 38, in which the dual rollers 12 are rotatively carried therebetween.

An element 42 at the rear of the retaining structure 14 is for stopping movement of the dual rollers 12 along the ground. The movement stopping element 42 is a braking device 44, that engages with the ground when the skater 18 lifts up a front portion of the foot holding component 16. The braking device 44 is a rubber bumper 46.

Figure 5:
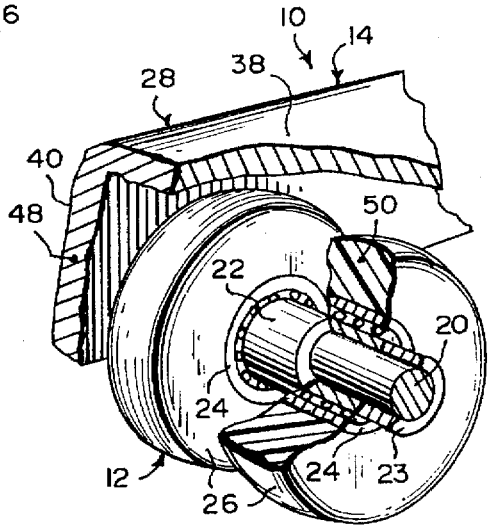
FIG. 5 is an enlarged perspective view with parts broken away and in section of the area indicated by arrow 5 in FIG. 2.

The retaining structure 14 is fabricated out of a durable strong material 48. The durable strong material 48 can be metal, as shown in FIG. 5 or plastic. Each narrow wheel 26 is fabricated out of a durable strong material 50. The durable strong material 50 can be plastic, as shown in FIG. 5, hard rubber or metal.

OPERATION OF THE INVENTION

To use the double line roller skates 10, the following steps should be taken:

1. Insert the right foot of the skater 18 into the right boot 30.
2. Tighten the laces of the right boot 30 and tie a bow.
3. Insert the left foot of the skater 18 into the left boot 30.
4. Tighten the laces of the left boot 30 and tie a bow.
5. Place the dual rollers 12 that are under the right boot 30 onto the ground.
6. Place the dual rollers 12 that are under the left boot 30 onto the ground.
7. Skate along the ground with greater stability and safety.

LIST OF REFERENCE NUMBERS

10 double line roller skate
12 dual roller of 10
14 retaining structure of 10
16 foot holding component of 10
18 skater
20 axle of 12
22 central bushing of 12 on 20
23 end bushing of 12 on 20
24 bearing of 12 on 20
26 narrow wheel of 12 on 24
28 inverted U-shaped channel bracket for 14
30 boot for 16
32 sole on 30
34 toe of 30
36 heel of 30
38 horizontal base of 28
40 vertical arm of 28
42 movement stopping element on 14
44 braking device for 42
46 rubber bumper for 44
48 strong durable material for 14
50 strong durable material for 26

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A double line roller skate comprising:

a) a plurality of more than two dual rollers;

b) means for retaining said dual rollers rotatively in a longitudinal alignment, one behind the other comprising an inverted U-shaped channel bracket with a horizontal solid flat base and a pair of vertical solid side walls extending downwardly;

c) means comprising a boot with a sole for holding said retaining means onto a foot of a skater, said base being attached to said sole of said boot;

d) each of said dual rollers including an axle supported at opposite ends in said side walls of said U-shaped bracket so that all of said rollers are between said side walls, a central bushing placed on said axle, a pair of end bushings on said axle, a pair of bearings with each of said bearings on said axle between said central bushing and one of said end bushings, and a pair of narrow wheels each of which is carried on one of said bearings, so that said central bushing extends from wheel to wheel, the plane of each of said wheels being perpendicular to the ground when said wheels are at rest and perpendicular to said sole of said boot; and e) single piece means mounted on the rear of said U-shaped channel for stopping movement of said dual rollers on the ground consisting of a rubber bumper extending rearwardly and downwardly and a member extending upwardly behind and above the sole of and along the back of said boot.

* * * * *